US006564953B2

(12) United States Patent
Ascik

(10) Patent No.: US 6,564,953 B2
(45) Date of Patent: May 20, 2003

(54) CONVERTIBLE POINT OF SALE DISPLAY SYSTEM AND METHODS FOR CONSUMER PRODUCTS

(75) Inventor: Mark A. Ascik, Ormond Beach, FL (US)

(73) Assignee: Capo, Inc., Ormond Beach, FL (US)

( * ) Notice: Subject to any disclaimer, the term of this patent is extended or adjusted under 35 U.S.C. 154(b) by 0 days.

(21) Appl. No.: 10/005,389

(22) Filed: Dec. 3, 2001

(65) Prior Publication Data

US 2002/0096483 A1 Jul. 25, 2002

Related U.S. Application Data

(60) Provisional application No. 60/258,166, filed on Dec. 22, 2000.

(51) Int. Cl.[7] ..... A47B 43/00
(52) U.S. Cl. ..... 211/189
(58) Field of Search ..... 211/85.1, 163, 211/85.3, 13.1, 189

(56) References Cited

U.S. PATENT DOCUMENTS 1,425,846 A * 8/1922 Franks
3,292,797 A * 12/1966 Berk ..... 211/163
4,296,866 A * 10/1981 Learnard ..... 211/163 X
4,322,007 A * 3/1982 Feibelman ..... 211/163
4,519,510 A * 5/1985 Learnard ..... 211/163 X
5,078,283 A * 1/1992 Wilson ..... 211/189 X
5,794,782 A * 8/1998 Ascik ..... 211/85.1 X
5,853,090 A * 12/1998 Brozak ..... 211/13.1
D445,273 S * 7/2001 Brown et al.
6,302,285 B1 * 10/2001 Fulle ..... 211/163 X
6,443,317 B1 * 9/2002 Brozak ..... 211/85.1

* cited by examiner

*Primary Examiner*—Robert W. Gibson, Jr.
(74) *Attorney, Agent, or Firm*—Allen, Dyer, Doppelt, Milbrath & Gilchrist, P.A.

(57) ABSTRACT

A display stand for presenting consumer merchandise and for controlling the aesthetic appearance of the merchandise includes at least three elongated corner posts which extend along a substantial portion of the vertical dimension of the stand, with each corner post having at least two pair of slots, each pair facing toward an adjacent corner post such that opposing slots on adjacent corner posts are positioned and dimensioned to receive vertically-extending and parallel first and second panels which may be used to control the appearance of the display, or present different types of merchandise as seasonally required.

22 Claims, 9 Drawing Sheets

CONVERTIBLE POINT OF SALE DISPLAY SYSTEM AND METHODS FOR CONSUMER PRODUCTS

CROSS-REFERENCE TO RELATED APPLICATIONS

This application incorporates by reference and claims priority to Provisional Application Serial No. 60/258,166 for "Convertible Point of Sale Display System and Methods for Consumer Products," having a filing date of Dec. 22, 2000, and commonly owned with this application.

BACKGROUND OF THE INVENTION

1. Field of the Invention

The present invention relates generally to systems and methods for displaying consumer products at a point of sale. In particular, the present invention relates to display systems and methods designed to be easily converted either for seasonal product variations or to modify the appearance of the display as inventory is sold down.

2. Description of the Prior Art

A variety of techniques have been used in the prior art to display consumer products at the point of sale. Of course, many staple products are simply stacked on fixed shelving. However, in the case of higher-priced or seasonal products such as sunglasses, eye glasses and costume jewelry, the products are frequently attached to a hang tag and suspended from pegs or slots on a vertical panel fixed to a floor stand. Typically, several vertical panels are attached together with vertical posts in a pleasing display on a single floor stand, and may be rotated about a vertical axis so that a stationary customer may view the products on all of the panels. Examples of prior art displays include those shown in U.S. Pat. Nos. 5,794,782 and 5,257,703, both to Ascik.

Prior art rotating vertical stands are often used to display seasonal merchandise such as sunglasses, jewelry and tanning lotions. As the goods are sold down during the season, the display becomes partially empty and thus less appealing to the consumer.

It is a custom in some industries for the manufacturer of the goods to supply the display stand to the retailer. In such cases, when a display stand with seasonal merchandise is occupying needed retail floor space during the off season, the retailer will often throw the display stand away. In that event, the manufacturer will be required to supply another display stand upon the arrival of the next selling season.

SUMMARY OF THE INVENTION

The present invention is directed to display stand constructions and methods which are designed to overcome the limitations discussed above, and to provide display stands which are converted in a facile manner at the point of sale to display or store different merchandise or a more limited amount of merchandise in a pleasing manner. In several arrangements, display stand constructions according to this invention employ lengths of spaced corner posts adapted to receive different display panels which are snapped into or fitted between adjacent pairs of the posts.

Further in accordance with this invention, the corner posts are also adapted to receive between adjacent pairs one or more inventory control panels which may be inserted in front of an existing display panel to provide a more pleasing appearance to the consumer as the merchandise on the existing display panel is sold down. Alternatively, the inventory control panel may be used to display the same merchandise, or different merchandise than is displayed on the rear panel.

In one specific arrangement, the above objectives are achieved using a construction employing three or more vertical corner posts, in which adjacent pairs of posts are spaced apart by a distance which defines an opening, the dimensions of the opening being generally equal to that of a display panel to be snapped into or fitted between the adjacent posts. Each post defines a corner of the display and includes a side facing an adjacent post with at least two recessed slots in each facing side. A first one of the slots in each of the adjacent pairs of posts is dimensioned to receive a side of a first display panel in the form of a thin sheet of vinyl or similar flexible material which is snapped into place in the first slots, usually with merchandise already mounted onto the panel. The second slot is outwardly from the first slot along the facing side of each post and is dimensioned to receive the second inventory control panel as the merchandise on the display panel is sold down.

Display stand constructions and methods of the present invention are also adapted to receive display panels of different configurations. For example, the opening between the facing sides of adjacent pairs of the posts may be dimensioned to receive a display panel formed as a corrugated tray having a display face and sides extending a short distance laterally from the display face, on the order of 2"–3", to provide structural integrity. In order to accommodate display panels of this type, the posts are provided with a rear stop positioned rearwardly of and extending beyond the first slot of the facing side.

Additionally, the display stand constructions and methods of the present invention are also adapted and dimensioned to receive removable shelving or storage containers in the opening between adjacent posts. In such an arrangement, the shelving or storage containers are dimensioned to fit between the extremities of opposing rear stops and rearwardly into the internal space of the display stand.

A detailed description of the drawings and preferred embodiments of the display stand constructions and methods of the present invention are set out next. It will of course be understood by those skilled in the art from the drawings and detailed descriptions that other constructions and methods may be employed which fall within the spirit and scope of this invention.

DETAILED DESCRIPTION OF THE PREFERRED EMBODIMENTS

Figure 1:
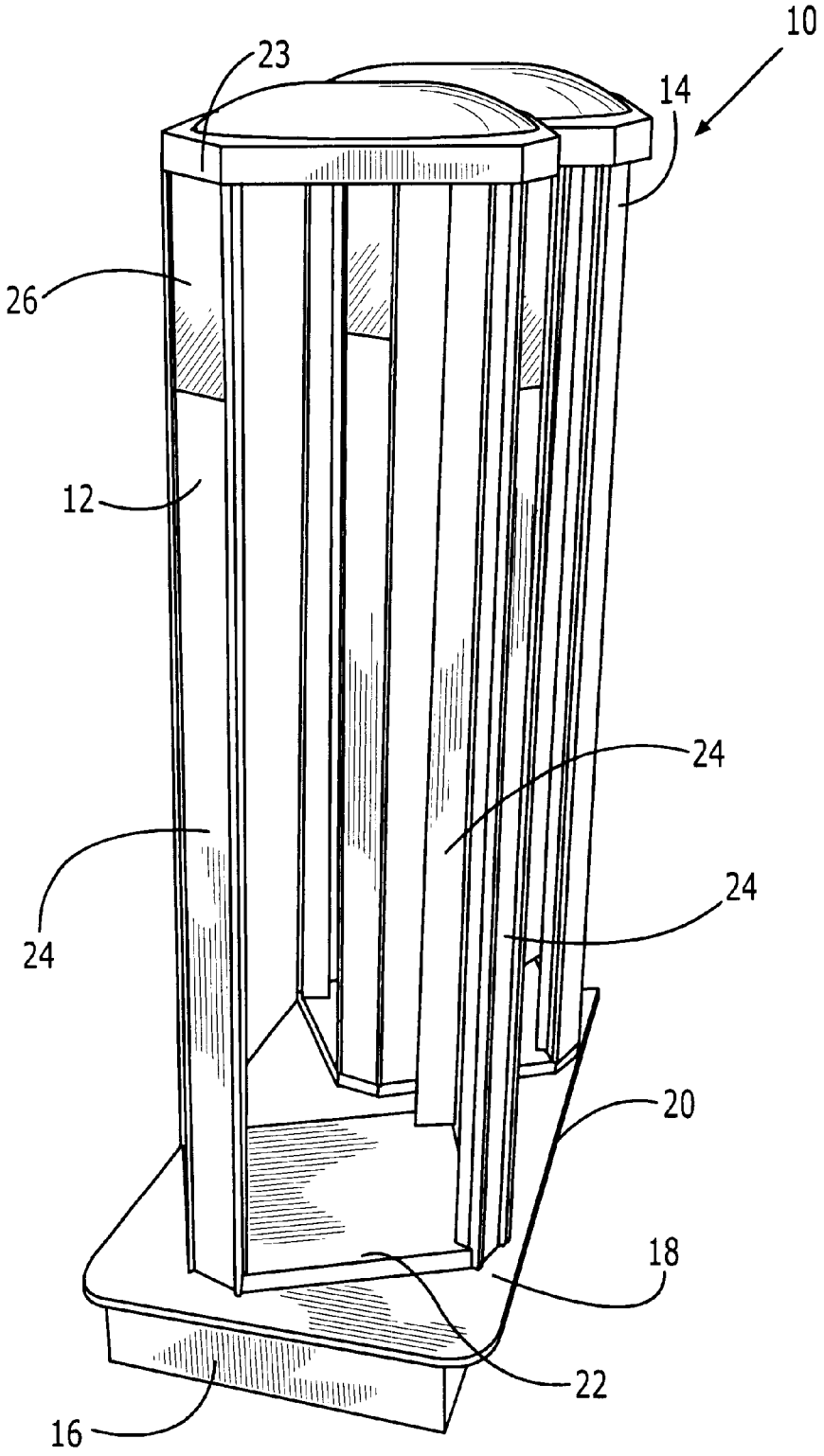
FIG. 1 is a perspective view illustrating a portion of a display stand system in accordance with the present invention.
Figure 2:
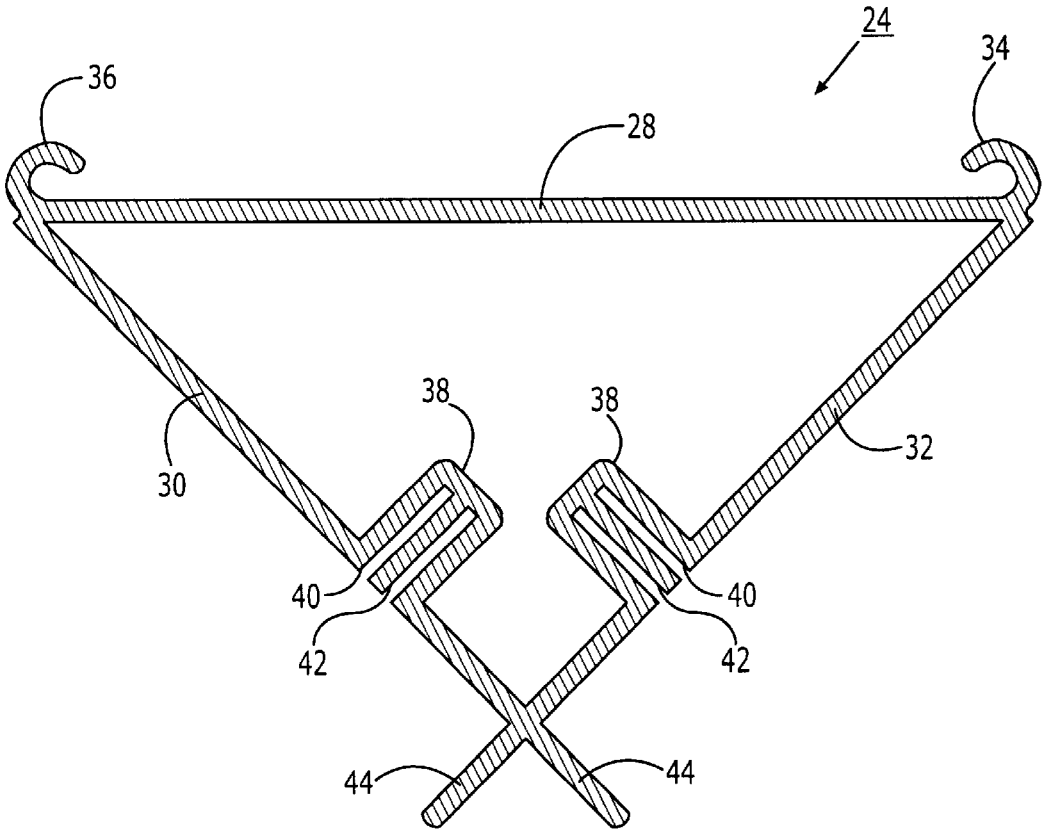
FIG. 2 is a cross-sectional view of a corner post useful in the display stand construction shown in FIG. 1.
Figure 3:
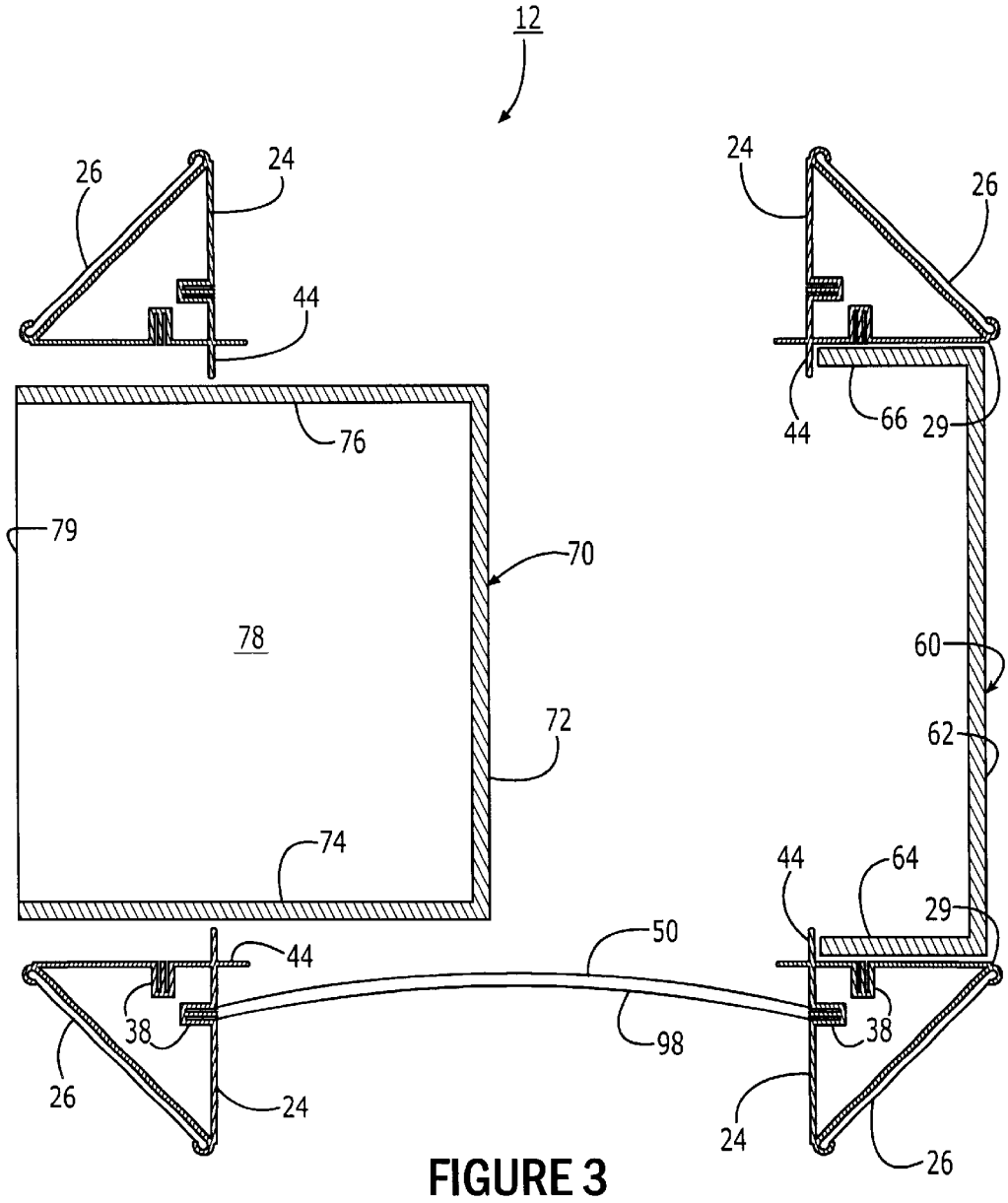
FIG. 3 is a cross-sectional illustration of a portion of the construction of the display stand system like that shown in FIG. 1, in which different display panels are illustrated as used with a plurality of corner posts.

Turning first to FIGS. 1–3, there is illustrated at FIG. 1 a display construction 10 having two generally vertical display stands 12, 14 mounted on a base plate 18, which in turn is mounted upon a stand 16. Although not shown in FIG. 1, the stand 16 may include rollers or casters to permit the entire assembly 10 to be wheeled about.

The base plate 18 includes an upper surface 20 to which is attached the vertical display stands 12, 14 in such a manner as to be rotatable around a vertical axis of rotation passing generally through each respective stand 12, 14. Each display stand 12, 14 includes a base 22 and a top 23, with four corners formed of relatively rigid corner posts 24 extending vertically between the base 22 and the top 23. The construction details of each post 24 and the manner in which each post 24 permits various display panels to be snapped into or fitted between adjacent pairs of posts will be described in greater detail below with reference to FIGS. 2 and 3.

Each display stand may include a mirror 26 mounted upon one or more corner posts 24. The mirror 26 is useful for consumers to try on merchandise suspended upon display panels fitted between adjacent pairs of edge molding 24, as described below.

Turning now to FIG. 2, corner post 24 comprises an elongated member of a molded or extruded plastic material which is formed in a generally triangular cross section so as to have an outer side 28, and inner sides 30, 32. The outer side 28 is provided with opposing retainers 34, 36 useful in holding the mirror 26 (FIG. 3) or promotional cards. Each of the inner sides 30, 32 is provided with a slot member 38 extending generally laterally from the respective side and defining a first, inner slot 42 and a second, outer slot 40. Additionally, each inner side 30, 32 includes a stop 44 extending generally laterally away from the inside extremity of each inner side.

Turning now to FIG. 3, a display stand construction 12 in accordance with the present invention employs four corner posts 24 like that shown in FIG. 2. Adjacent corner posts 24 are spaced apart a distance which defines an opening equivalent in dimension to a display panel 50, 60 or 70. Display panel 50 is shown in greater detail in FIG. 7. Display panel 50 comprises a thin sheet of flexible vinyl material which is fitted at opposite ends into first, inner slots 42 of a pair of the corner posts 24.

Figure 7:
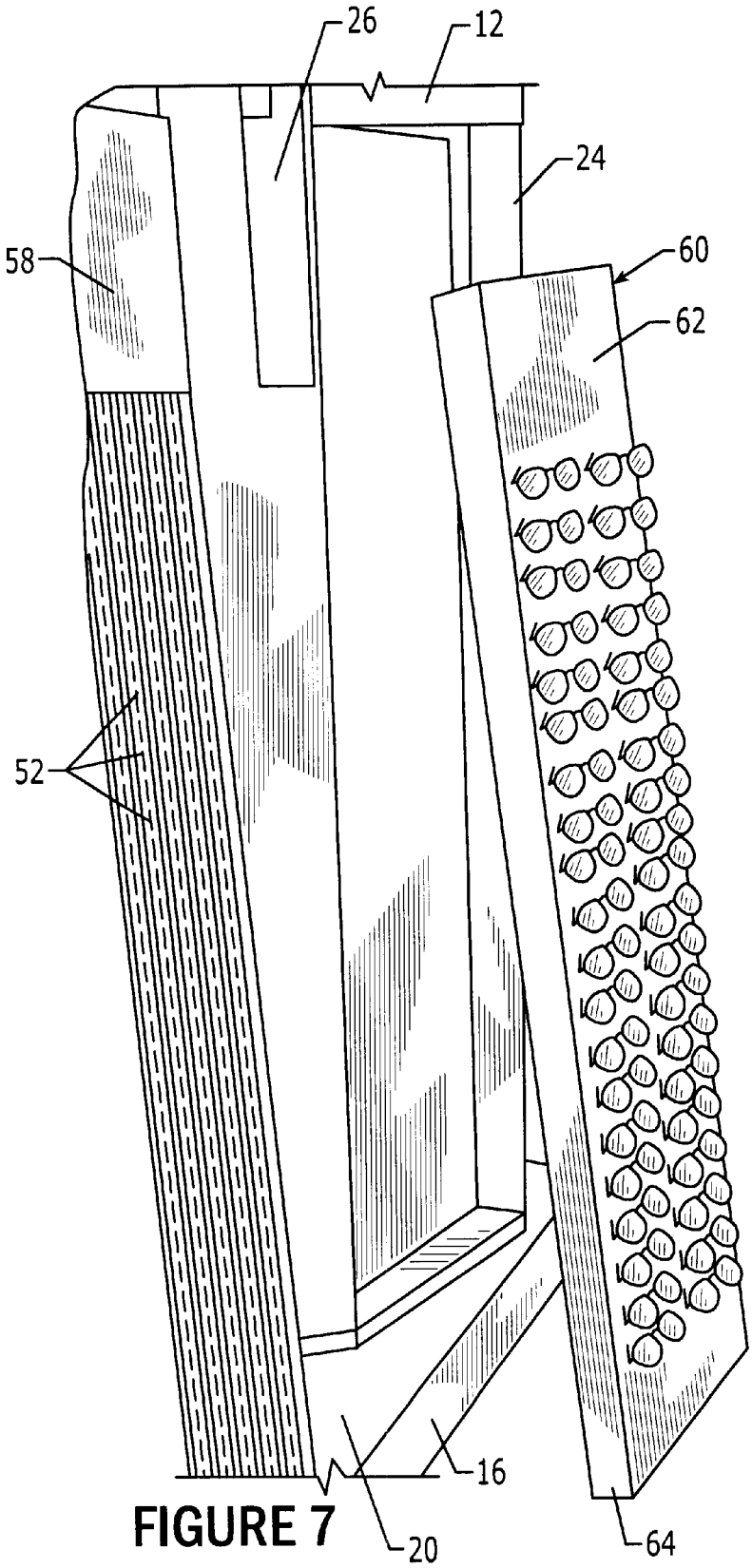
FIG. 7 is a partially cut-away perspective view of a display system of the present invention, and showing alternative display panels useful with a display system.
Figure 8:
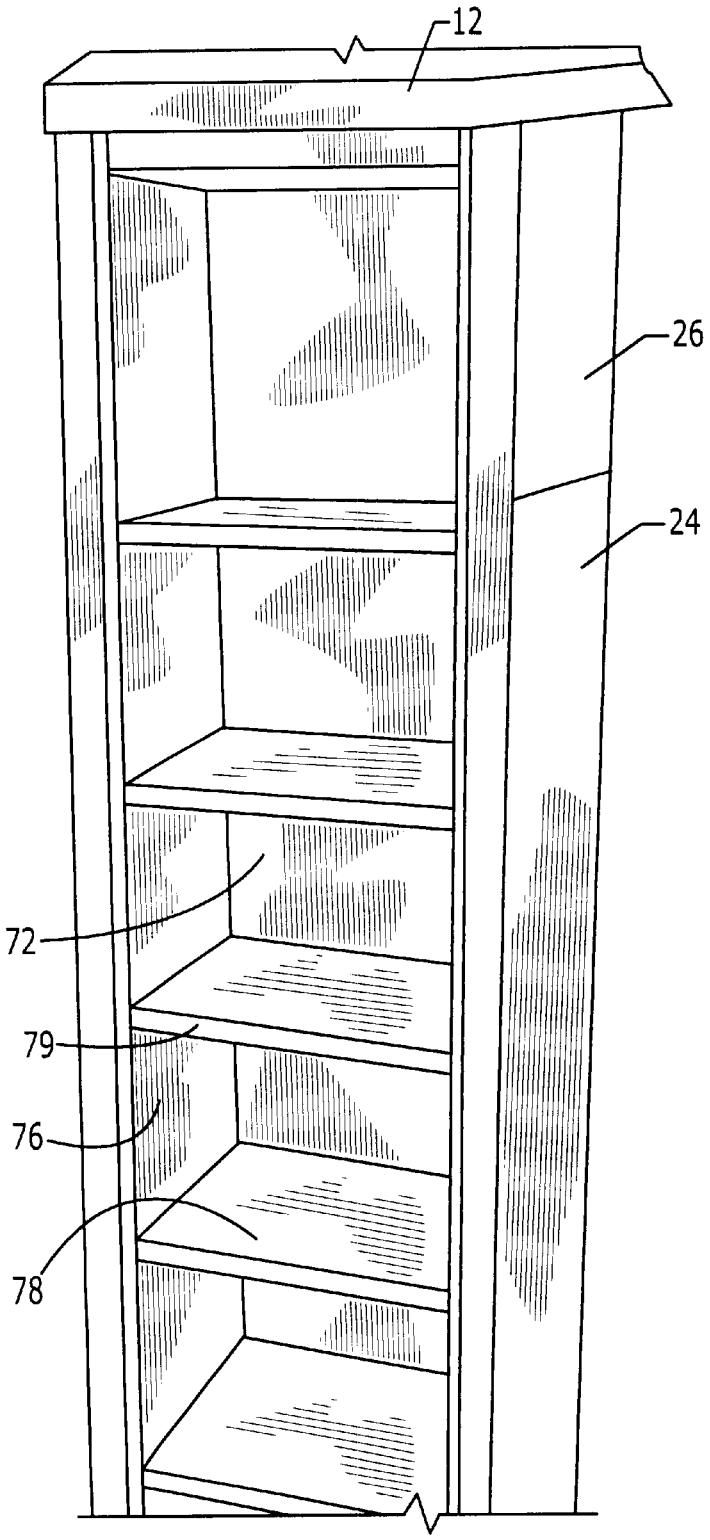
FIG. 8 is a partially cut-away perspective view of a display stand like that shown in FIGS. 1–3, and illustrating in side view one of the alternative display panels shown in FIG. 3.

Again noting FIG. 3, display panel 60 comprises a tray formed of corrugated material having a front panel 62 and side panels 64, 66 which extend in the opening between adjacent panels and are dimensioned to rest against the stops 44 of adjacent posts 24 with the front panel 62 extending to the front edges 29 of the adjacent corner posts (see FIG. 3). Display panel 60 is also shown in FIG. 7. Display panel 70 comprises a corrugated shelf member having a back panel 72, side panels 74, 76 and shelf panels 78 and is dimensioned to fit between the adjacent stops 44. Display panel 70 is shown in greater detail in FIG. 8.

Figure 9:
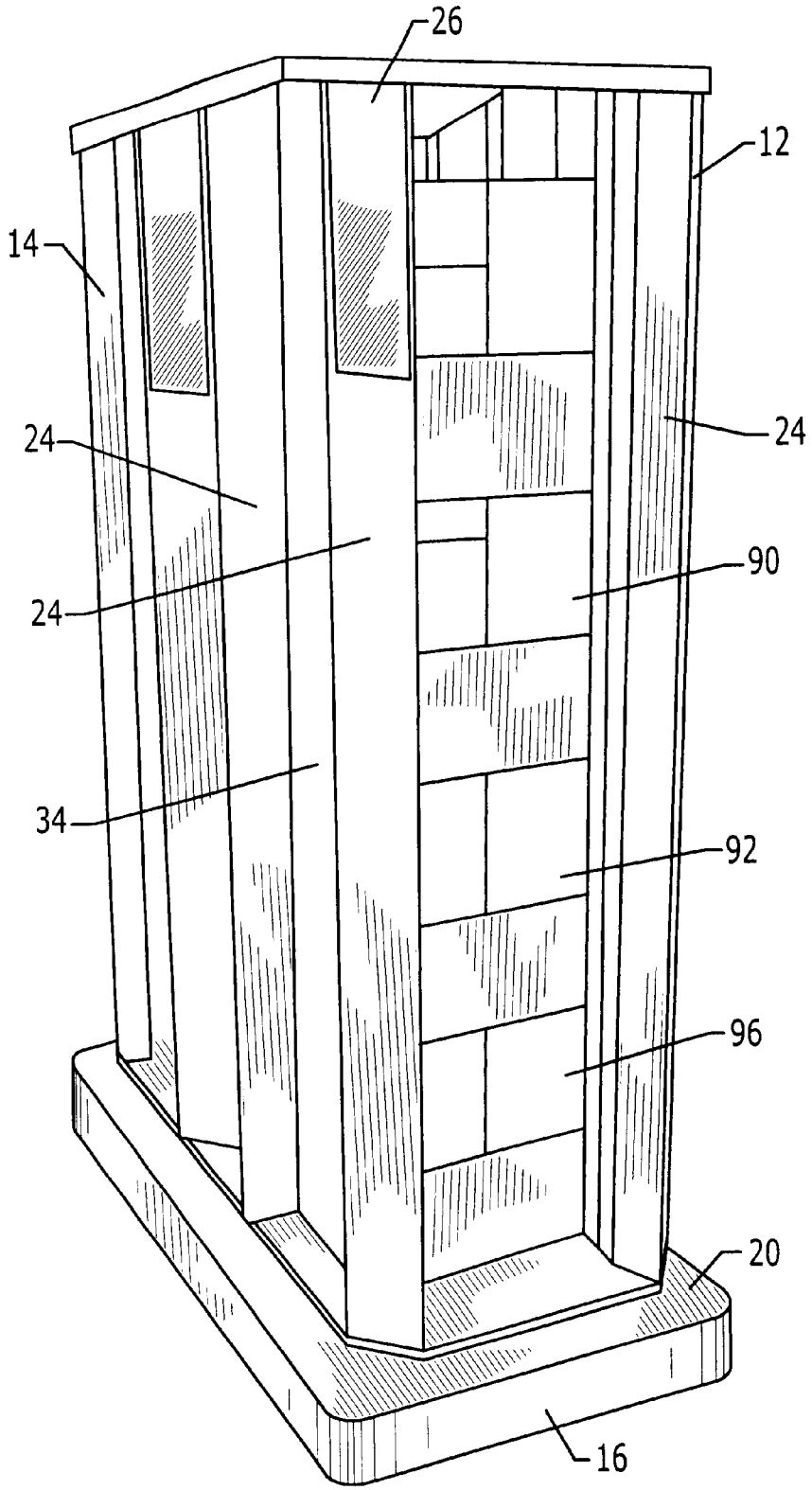
FIG. 9 is perspective view of a display stand system according to the present invention, illustrating another alternate form of a display panel for insertion between adjacent corner posts.

In addition to display panels 50, 60 and 70 as discussed above, display panel 90 shown in FIG. 9 may also be employed for insertion into the space defined by the four corner posts 24 in FIGS. 1 and 3. As shown in FIG. 9, display panel 90 includes vertical corrugated sides 92, 94 and slidable corrugated drawers 96. Display panel 90, like panel 70, is dimensioned to extend into the display stand 12 between adjacent stops 44. An inventory control panel 98 (FIG. 6) may also be used with the display stand 12, for the purposes discussed above.

Figure 4:
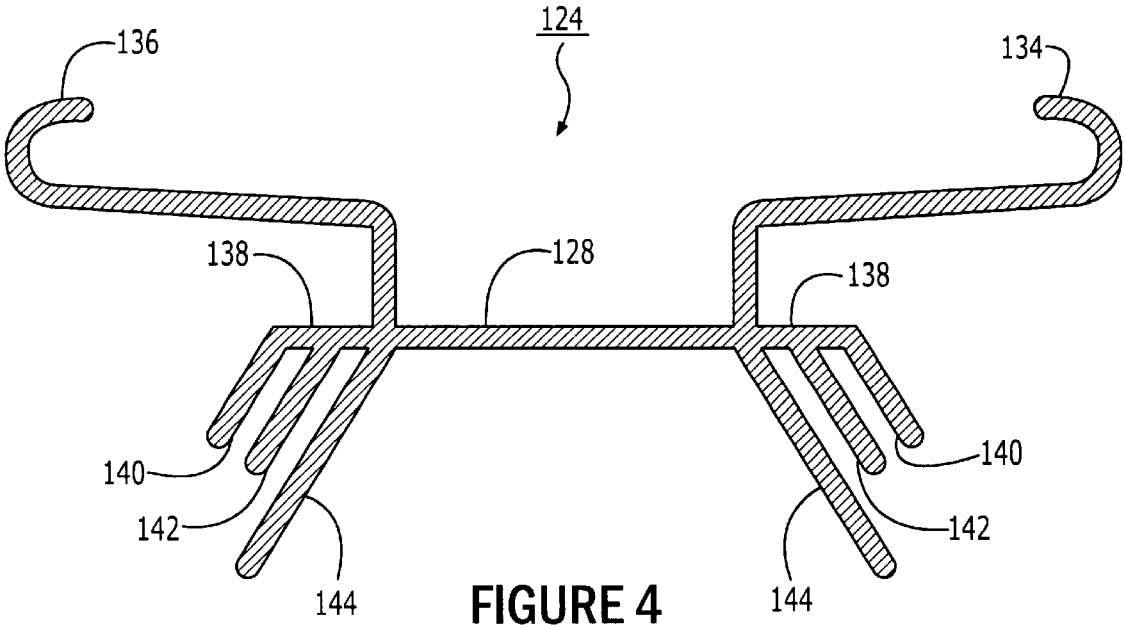
FIG. 4 is a cross section of another preferred embodiment of a corner post in accordance with the present invention.

A second embodiment of a corner post construction in accordance with the present invention is illustrated in FIG. 4 and referred to generally with reference numeral 124. Corner post construction 124 includes a front side 128 and slot members 138, each of which define a first, inner slot 142 and a second, outer slot 140 both extending laterally from the inside of side 128. Additionally, each side of the corner post 124 is provided with a stop 144. Opposing retainers 134, 136 are adapted to hold mirror 26 or a promotional card.

Figure 5:
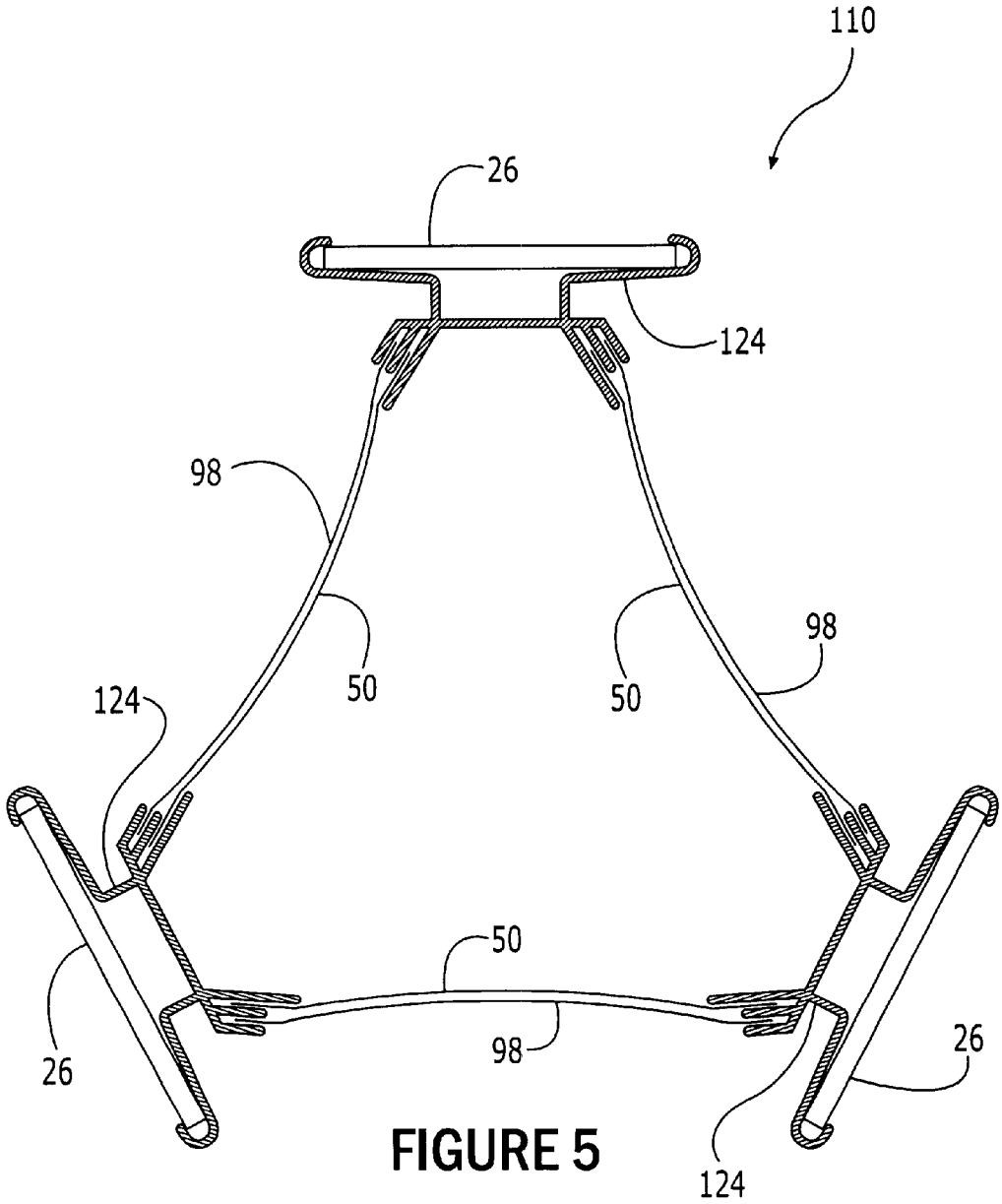
FIG. 5 is a cross sectional illustration of a display stand construction utilizing at three corners the corner post of FIG. 4, and illustrating the manner in which an inventory control panel is inserted in front of a display panel.

The particular manner in which the corner post construction of FIG. 4 is utilized in a display stand construction 110 is shown in the cross section of FIG. 5. Display panels 50 are shown inserted in the first, inner slot 142 of adjacent pairs of corner posts 124, with inventory control panels 98 inserted in front of each display panel 50 in the second, outer slots 140 of adjacent corner posts 124.

Figure 6:
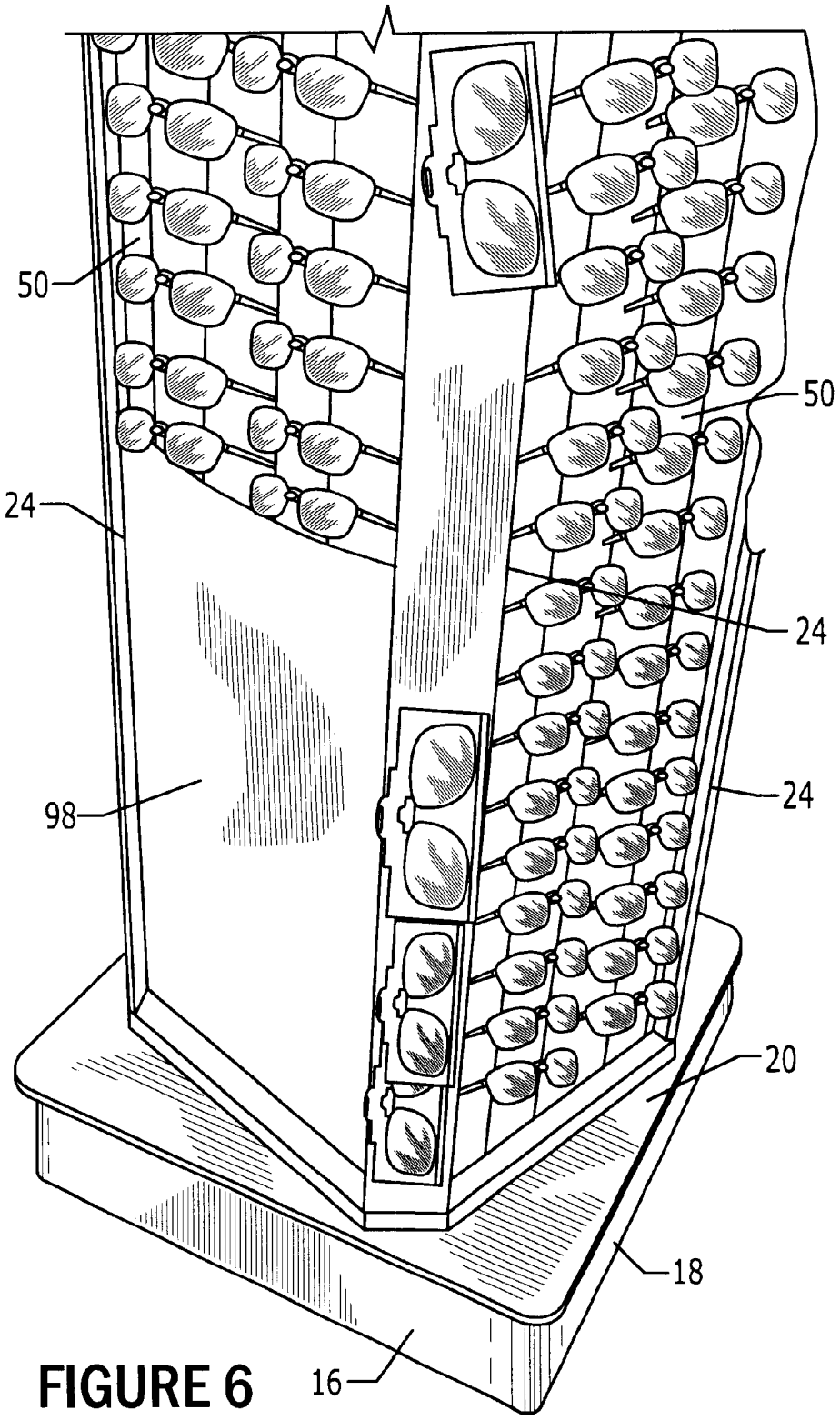
FIG. 6 is a perspective view of a cut-away portion of a display stand in accordance with the present invention, illustrating the use of the inventory control panel.

The inventory control panel 98 is shown in greater detail in FIG. 6, and comprises a graphic or other promotional insert which permits merchandise to be moved into the upper portion of the display panel 50, thereby avoiding the unsightly appearance of a display panel which contains only a small portion of merchandise for the overall panel. Alternatively, another type of merchandise (such as costume jewelry) may be carried by the inventory control panel 98.

It will be recognized by those skilled in the art that various modifications and changes can be made in the display stand constructions and methods shown and described above, without departing from the spirit and scope of this invention.

What is claimed is:

1. A display stand comprising:

a base;

an elongated display stand supported generally vertically upon the base, the display stand defined by plural elongated corner posts, each of which— a) is spaced from adjacent corner posts and extends along a substantial portion of the vertical dimension of the display stand, b) includes at least two pair of slots with each pair of slots facing toward an adjacent corner post and extending generally vertically along the corresponding corner post; and wherein opposing slots on adjacent corner posts are each positioned and dimensioned to receive a display panel therein, such that an adjacent pair of corner posts may simultaneously vertically support at least independent first and second display panels between the adjacent corner posts.

2. The display stand recited in claim 1, further comprising a first vertically-extending display panel supported in first slots of the adjacent corner posts and a second vertically-extending panel supported in second slots of the adjacent corner posts.

3. The display stand recited in claim 2, wherein each of the first and second vertically-extending panels comprise thin flexible sheeting.

4. The display stand recited in claim 3, wherein an outer one of the first and second vertically-extending panels has a smaller vertical dimension than the other vertically-extending panel.

5. The display stand recited in claim 4, wherein opposing pairs of slots in the adjacent corner post extend generally parallel, whereby the first and second vertically-extending panels extend generally parallel with each other.

6. The display stand recited in claim 1, wherein each corner post comprises a pair of slot members, each slot member extending laterally from an inside surface of the corresponding corner post and including one pair of the slots.

7. The display stand recited in claim 6, wherein the lateral direction of each slot member is generally parallel with the plane of the first and second display panels to be supported in the slots thereof.

8. The display stand recited in claim 6, wherein each corner post further comprises a pair of stop members, each stop member extending beyond an adjacent slot member toward an adjacent corner post.

9. The display stand recited in claim 8, wherein the dimension between the stop members of adjacent corner posts and the dimension between the front edge of each corner post and a corresponding stop member are adapted to receive a tray display, the display stand further comprising a tray display resting against adjacent pairs of stop members and having a front panel fitted between the front edges of adjacent corner posts.

10. The display stand recited in claim 8, wherein the dimension between the stop members of adjacent corner posts is adapted to receive a shelving display extending interiorly beyond the adjacent corner post.

11. A display stand comprising:

a base;

an elongated display stand supported vertically upon the base, the display stand defined by at least three spaced, elongated corner posts, each of which extends along a substantial portion of the vertical dimension of the display stand;

a first vertically-extending display panel supported between a first pair of adjacent corner posts for supporting merchandise to be displayed;

a second vertically-extending panel supported between the first pair of adjacent corner posts, the second vertically-extending panel having a vertical dimension which is substantially less than the first vertically-extending display panel; and wherein each corner post includes at least two pair of slots with each pair of slots facing toward an adjacent corner post and extending generally vertically along the corresponding corner post, and wherein opposing slots of adjacent corner posts are each positioned and dimensioned to receive a display panel therein, such that an adjacent pair of corner posts may simultaneously vertically support both the first and second vertically-extending panels.

12. The display stand recited in claim 11, wherein each corner post comprises a pair of slot members, each slot member extending laterally from an inside surface of the corresponding corner post and including one pair of the slots.

13. The display stand recited in claim 12, wherein the lateral direction of each slot member is generally parallel with the plane of the first and second vertically-extending panels to be supported in the slots thereof.

14. The display stand recited in claim 12, wherein each corner post further comprises a pair of stop members, each stop member extending beyond an adjacent slot member toward an adjacent corner post.

15. The display stand recited in claim 14, wherein the dimension between the stop members of adjacent corner posts and the dimension between a front edge of each corner post and a corresponding stop member are adapted to receive a tray display, the display stand further comprising a tray display resting against adjacent pairs of stop members, the tray display having a front panel fitted between the front edges of adjacent corner posts.

16. The display stand recited in claim 11, wherein each of the first and second vertically-extending panels comprises thin flexible sheeting.

17. The display stand recited in claim 16, wherein the pair of slots in the adjacent corner posts extend generally parallel, whereby the first and second vertically-extending panels extend generally parallel with each other.

18. A method for presenting consumer merchandise on a display stand and for controlling the appearance of the stand, the method comprising the steps of:

fitting the display stand with at least three spaced, vertically-extending corner posts;

providing each corner post with at least two pair of parallel slots, each pair of slots on opposite sides of each corner post;

installing the corner posts in the display stand with a pair of the slots of one corner post facing a corresponding pair of slots in an adjacent corner post;

inserting a first, vertically-extending display panel in a first, rearward slot on each of the adjacent corner posts; and inserting a second, vertically-extending panel having a smaller vertical dimension than the first panel into a second, forward slot on each of the adjacent corner posts.

19. The method recited in claim 18, further comprising the step of inserting the second, vertically-extending panel into the display stand after merchandise carried by the first, vertically-extending display panel has sold down, in order to impart a more pleasing overall appearance to the display stand.

20. The method recited in claim 18, further comprising the step of displaying merchandise on the second, vertically-extending panel of a different type than that displayed on the first, vertically-extending display panel.

21. The method recited in claim 18, further comprising the steps of:

providing a rearward stop on each adjacent corner post;

removing the first and second vertically-extending panels; and inserting a tray display into the display stand and against adjacent rearward stops, the tray display having a front panel which is flush with front edges of the corner post.

22. The method recited in claim 18, further comprising the steps of:

removing the first and second vertically-extending panels; and inserting a shelf display into the display stand, the shelf display extending into the interior of the display stand and between adjacent corner posts.

* * * * *